US008419487B2

(12) United States Patent
Parker

(10) Patent No.: US 8,419,487 B2
(45) Date of Patent: Apr. 16, 2013

(54) INTERNALLY MOUNTED WATERCRAFT ROWING FIN SYSTEM

(76) Inventor: Jack Parker, Snoqualmie, WA (US)

( * ) Notice: Subject to any disclaimer, the term of this patent is extended or adjusted under 35 U.S.C. 154(b) by 79 days.

(21) Appl. No.: 12/856,309

(22) Filed: Aug. 13, 2010

(65) Prior Publication Data

US 2011/0039460 A1 Feb. 17, 2011

Related U.S. Application Data

(60) Provisional application No. 61/233,510, filed on Aug. 13, 2009.

(51) Int. Cl.
*B63H 1/30* (2006.01)
*B63H 16/04* (2006.01)

(52) U.S. Cl.
USPC ..... 440/13; 440/21

(58) Field of Classification Search ..... 440/13, 440/21, 25, 32, 101, 102, 105, 106, 107, 440/108, 109
See application file for complete search history.

(56) References Cited

U.S. PATENT DOCUMENTS

| | | | | | |
|---|---|---|---|---|---|
| 871,059 | A | | 11/1907 | Douse | |
| 892,418 | A | * | 7/1908 | Hallman | 440/25 |
| 2,330,332 | A | | 9/1943 | Boon | |
| 2,693,163 | A | * | 11/1954 | Mims | 440/21 |
| 2,696,797 | A | | 12/1954 | Whidden | |
| 2,873,713 | A | | 2/1959 | Baastrup | |
| 2,875,723 | A | | 3/1959 | Moore | |
| 3,086,492 | A | | 4/1963 | Holley | |
| 3,297,283 | A | | 1/1967 | Knaver | |
| 3,640,240 | A | * | 2/1972 | Stein | 440/15 |
| 3,677,216 | A | | 7/1972 | Gentemann | |
| 3,855,957 | A | | 12/1974 | Gross | |
| 4,345,903 | A | | 8/1982 | Laser | |
| 4,434,738 | A | * | 3/1984 | Barkemeyer | 114/162 |
| 4,867,719 | A | * | 9/1989 | duPont | 440/101 |
| 4,892,493 | A | | 1/1990 | Gil | |
| 5,364,296 | A | | 11/1994 | Cerny | |
| 6,193,466 | B1 | | 2/2001 | Earl | |
| 6,755,706 | B1 | | 6/2004 | Lin | |
| 6,843,691 | B1 | | 1/2005 | Jelten | |
| 7,396,267 | B1 | * | 7/2008 | Parker | 440/105 |
| 7,895,959 | B1 | * | 3/2011 | Angel et al. | 114/163 |
| 2003/0179963 | A1 | * | 9/2003 | Hokkirigawa et al. | 384/97 |

* cited by examiner

*Primary Examiner* — Stephen Avila
*Assistant Examiner* — Andrew Polay
(74) *Attorney, Agent, or Firm* — Dean A. Craine

(57) ABSTRACT

An internally mounted rowboat rowing fin system that includes two rotating fin assemblies mounted on the inside surface of the watercraft's opposite sidewalls. Each fin assembly includes a rotating vertical post held on the inside surface of the sidewall by a mounting tube selectively mounted or integrally formed on the sidewall. Longitudinally aligned and disposed inside each mounting tube is a hollow, elongated sleeve. Disposed inside each elongated sleeve is a rotating post that extends upward above the gunwale and into the water below the elongated sleeve. A pivoting fin arm with a flexible fin attached thereto is pivotally attached to the lower end of each rotating post. Attached to the upper end of each rotating post is a perpendicularly aligned handle bracket. A rowing handle is pivotally attached at one end to the handle hinge. During use, the two handles extend inward from the sidewall and are grasped by the rower. Both handles are able to swing in a vertical 180 arc over their respective handle hinges thereby allowing the fins to rotate 180 and sweep in opposite directions.

9 Claims, 8 Drawing Sheets

INTERNALLY MOUNTED WATERCRAFT ROWING FIN SYSTEM

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

This is a utility patent application which claims benefit of U.S. Provisional Application No. 61/233,510, filed on Aug. 13, 2009.

BACKGROUND OF THE INVENTION

1. Field of the Invention

The invention disclosed herein pertains to manual propulsion systems for a small watercraft and more particularly to manual rowing systems used on small watercraft.

2. Description of the Related Art

Any small watercraft propelled by oars is called a rowboat or skiff. When such boats are used to service a larger watercraft such as a yacht or motor cruiser, they are called a dinghy or tender.

Conventional rowboats include oarlock sockets mounted to the gunwales on the opposite sides of the hull. Attached to each oar is an oarlock that includes a post that slides downward and engages an oarlock socket that pivotally attaches the oar to the gunwale. The post, which is able to rotate freely inside the socket, may be easily lifted from the oarlock socket to remove the oars from the rowboat.

In U.S. Pat. No. 7,396,267, the Inventor discloses a manual rowing fin system for a small watercraft, such as a rowboat, that includes two rotating fin assemblies mounted on the opposite sidewalls of the small watercraft. Each fin assembly includes a vertically aligned, rotating post disposed over the outside surface of the sidewall. The post is held in position on the sidewall by a mounting bracket affixed to the outside surface of the sidewall. In the first embodiment, the length of the post is sufficient to extend from the gunwale to a point just below the watercrafts' keel. The post is able to rotate freely 360 degrees around its vertical axis when attached to the mounting bracket. A pivoting fin arm with a flexible fin is attached to the lower end of each post. The fin arm is able to rotate upward and downward in a vertical arc around the end of the post thereby allowing the fin attached thereto to be deflected up or down by objects in the water or folded into an upward retracted position against the sidewall when lifting the watercraft from the water. A stop hinge is disposed between the end of the fin arm and to the lower end of the post, which limits the rotation of the fin arm to a 90 degree arc.

One drawback with the rowing system shown in the '297 patent is that mounting bracket for holding the post is affixed to the outside surface of the watercraft which destroys the watercraft's overall appearance. Another drawback is that it creates another structure that extends laterally from the hull which can interfere with storage and transportation.

SUMMARY OF THE INVENTION

It is an object of the present invention to provide an alternative rowing system for a small watercraft that does not use long oars that extend laterally from the port and starboard sides of the watercraft.

It is another object of the present invention to provide such a rowing system and allows the user to easily row in opposite directions without having to reposition him or herself in the watercraft.

It is another object of the present invention to provide such a rowing system that does not substantially change the watercraft's overall appearance and allows the watercraft to be easily stored and transported.

These and other objects are met by a manual rowing fin system for a small watercraft, such as a rowboat, that includes two rotating fin assemblies mounted on the opposite sidewalls of the small watercraft similar to the rotating fin assemblies shown in U.S. Pat. No. 7,396,267, and incorporated herein.

Each fin assembly includes a vertically aligned, rotating post disposed over the inside surface of a sidewall. The rotating post is held in place by a vertically aligned mounting tube located on the inside surface of the sidewall. In one embodiment, the mounting tube a separate component designed as an aftermarket product that is separately connected and sealed to the inside surface of the hull. In a second embodiment, the mounting tube is an integrally formed structure constructed directly into the sidewall of the hull. In both embodiments, the mounting tube includes an inner bore through which a non-rotating intermediate elongated hollow sleeve is placed. The length of the mounting tube is sufficient so that it extends through the hole formed in the hull adjacent to or near the chine. The elongated sleeve is longitudinally aligned inside the mounting tube and is designed to extend slightly below the lower end of the mounting tube. The elongated sleeve includes a longitudinally aligned bore through which the rotating post extends. The lower gap that may be created between the hull and the mounting tube may be sealed or filled with a watertight, suitable sealer.

The rotating post is sufficient in length to extend downward through the elongated sleeve and below the chine, Like the fin system shown in the '267 patent, a fin arm is pivotally attached to the lower end of the rotating post, and may rotate upward and downward in a vertical arc around the end of the post thereby allowing the fin to be deflected up or down by objects in the water or folded into an upward retracted position against the sidewall when lifting the watercraft from the water. Also, like the fin system shown in the '267, the attached to the upper end of each rotating post is a perpendicularly aligned, fixed handle hinge. When properly assembled, the longitudinal axis of the handle hinge is perpendicularly aligned with the stop hinge's and the fin arm's longitudinal axis. Longitudinally aligned on the handle hinge is an elongated rowing handle. The rowing handle is pivotally attached at one end to the handle hinge and is able to swing 180 degrees in a vertical arc over the handle hinge.

Because the mounting tube and elongated sleeve are located inside the hull, the turning radius of each fin assembly closer to the center axis of the hull thereby making the hull more reactive to the movement of the fins. Also, because the mounting tube and elongated sleeves are not visible when the hull is viewed from the side, the hull has an appearance of a hull used on a standard row boat. Because no structures extend laterally over the sidewalls, the watercraft can be positioned directly against a dock or another boat. Also, because the top of the gunwale is not blocked, a standard set of oars may still be used with the watercraft if desired.

DESCRIPTION OF THE PREFERRED EMBODIMENT(S)

Figure 1:
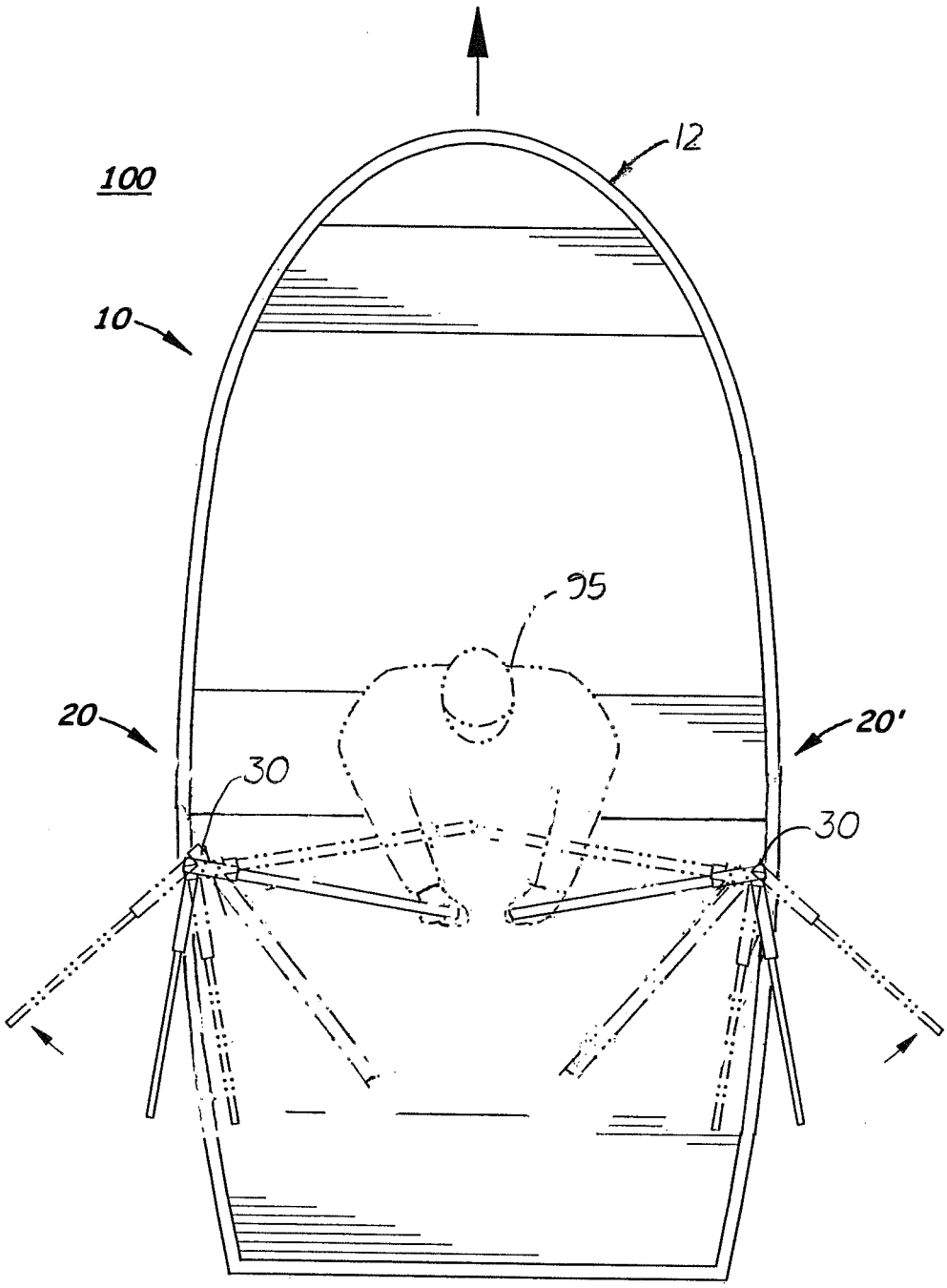
FIG. 1 is a top plan view of a manual rowing system mounted on opposite sides of a rowboat showing a rower rowing the rowboat in a forward direction.

Shown in the accompanying FIGS. 1-12, there is shown an improved manual rowing system 10 used propel a rowboat 12 in a body of water 100 comprising two rotating fin assemblies 20, 20' mounted directly across from each other on the opposite sidewalls 14, 16 of the rowboat 12. The invention disclosed herein is an improvement of the manual rowing system shown and described in U.S. Pat. No. 7,396,276, which is incorporated by reference herein. In both systems, two fin arm assemblies 20, 20' are attached to the opposite sidewalls of a rowboat 12 that allow the rower 95 to easily row the rowboat 12 in opposite directions while sitting in the same location inside the rowboat 12.

Figure 11:
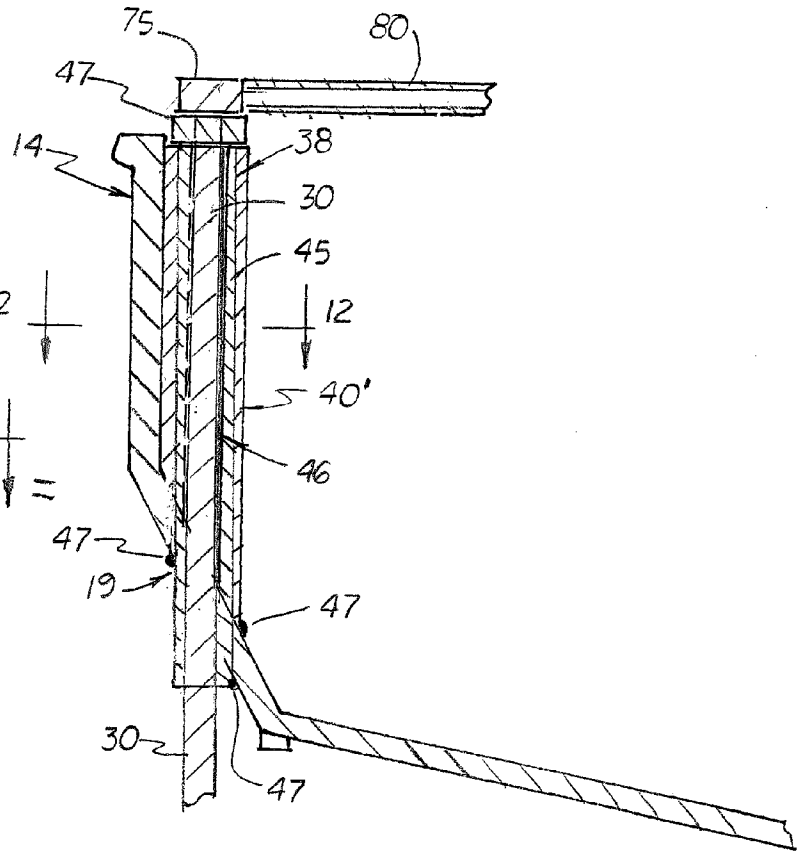
FIG. 11 is a sectional side elevational view of the watercraft taken along line 11-11 in FIG. 10.
Figure 12:
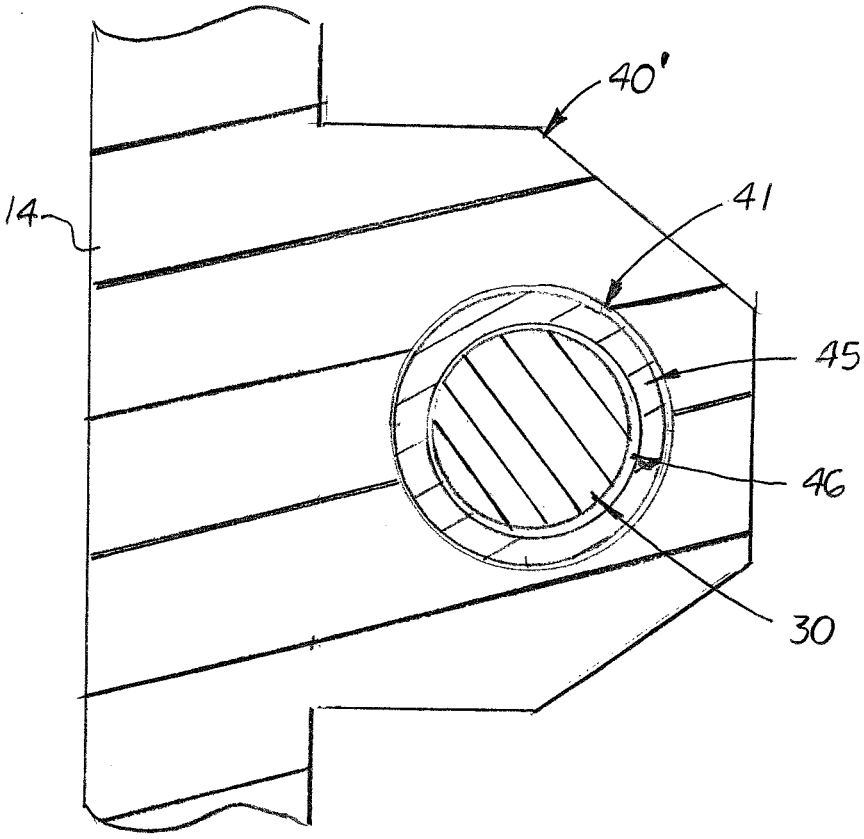
FIG. 12 is a sectional top plan view of the watercraft taken along line 12-12 in FIG. 11.

In the first embodiment shown in FIGS. 3, 4, 8 and 9 each fin assembly 20 includes a rotating post 30 disposed inside a mounting tube 40 vertically aligned on the inside surface of the sidewall 14 of the rowboat 12. The mounting tube 40 is designed to be an aftermarket product which is selectively attached to an existing rowboat 12. The mounting tube 40 includes an upper flange 44 that securely attaches to the top surface of the gunwale 15. The mounting tube 40 extends downward along the inside surface 14A of the sidewall 14, 15 of the rowboat 12 and extends through a hole 19 formed thereon. FIGS. 10, 11 and 12 show a second embodiment is shown in which the mounting tube 40' is integrally formed on the inside surface 14A of the side wall 14. In both embodiments, the rotating post 30 is sufficient in length to extend downward through the elongated sleeve 45 and below the chine 100.

Both mounting tubes 40, 40' includes a continuous inner bore 41 through which a longitudinally aligned, hollow elongated sleeve 45 is placed. The elongated sleeve 45 includes an upper flange surface 47 upon which a hinge 75 rests. The lower edge of the elongated sleeve 45 extends through the hole 19 and may be sealed with a suitable sealer 47.

Figure 4:
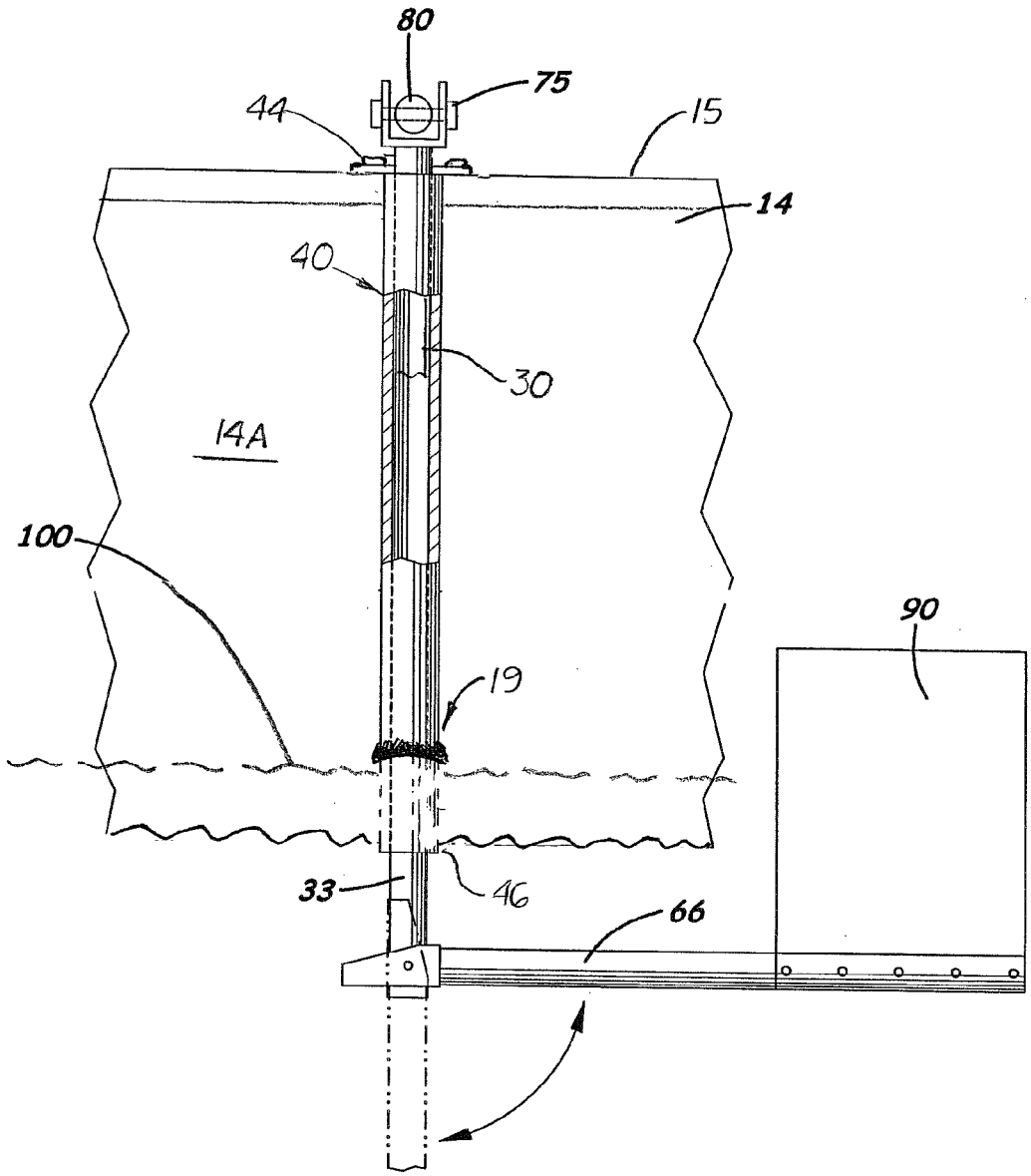
FIG. 4 is a side elevational view of the inside surface of the sidewall showing the post assembly placed inside the mounting tube and the fin assembly attached to the end of the post and being deflected upward.
Figure 5:
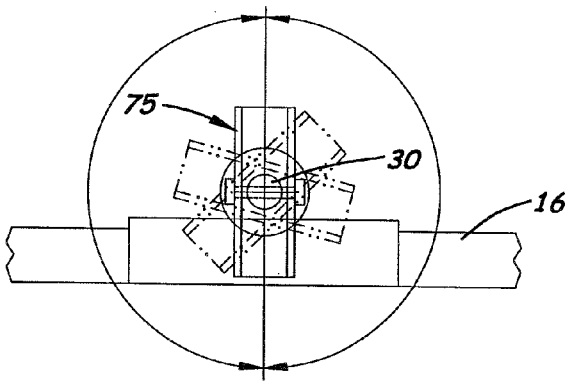
FIG. 5 is a top plan view of the handle bracket being rotated on the mounting bracket.
Figure 7:
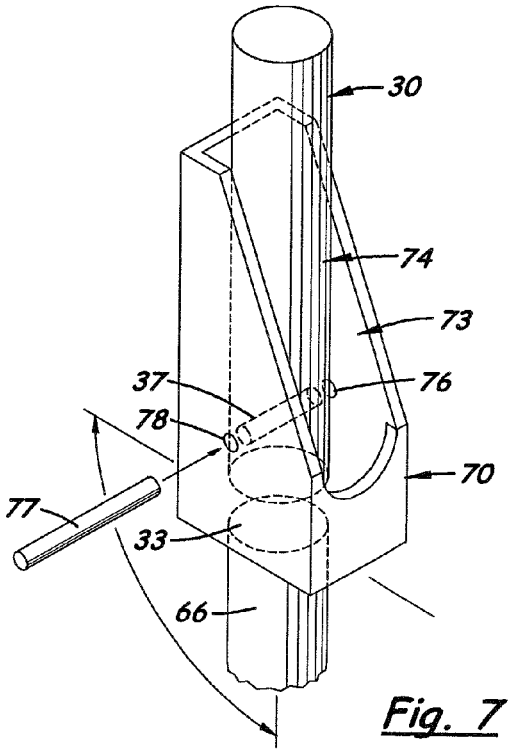
FIG. 7 is a perspective view of the lower end of a post extending through a stop hinge attached to the upper end of the fin arm.

As fully described in the '267' patent and now shown in FIG. 4, the fin assembly 20 includes a straight, rigid fin arm 66 with a flexible fin 90 attached to its distal end. In the first embodiment, a stop hinge 70 is attached or mounted to the proximal end of the fin arm 66. As shown in FIG. 7, the stop hinge 70 is a hollow elongated structure with a diagonal cut section formed in its upper section. Formed inside the stop hinge 70 is an elongated cavity 73 designed to receive the lower section of the post 30. A side opening 74 is formed on its stop hinge 70 through which the post 30 may extend when the fin arm 66 is rotated upward. Formed on the lower end of the stop hinge 70 are two transversely aligned bores 76, 78. A pin 77 is extended through the two bores 76, 78 and through a bore 37 formed on the post 30 to pivotally connect the stop hinge 70 to the post 30. The fin arm 66 is longitudinally aligned and securely attached at its upper end to the stop hinge 70.

The fin arm 66 is sufficient in length so that the top of the flexible fin 90 may extend below the watercraft's keel 112. During use, the post 30, the fin arm 66 and the fin 90 are able to rotate freely as a unit 360 degrees. Also, the stop hinge 70 enables the fin arm 66 to rotate in a vertical arc over the lower end 33 of the rotating post 30 thereby allowing the fin 90 to be deflected up or down by objects in the water 100 or folded into an upward retracted position against the sidewall 14, 16 when lifting the rowboat 12 from the water 100.

The fin 90 is perpendicularly aligned and attached to the lower end of the fin arm 66 on second post 30'. In the preferred embodiment, the fin 90 is of flexible rubber or plastic.

Figure 3:
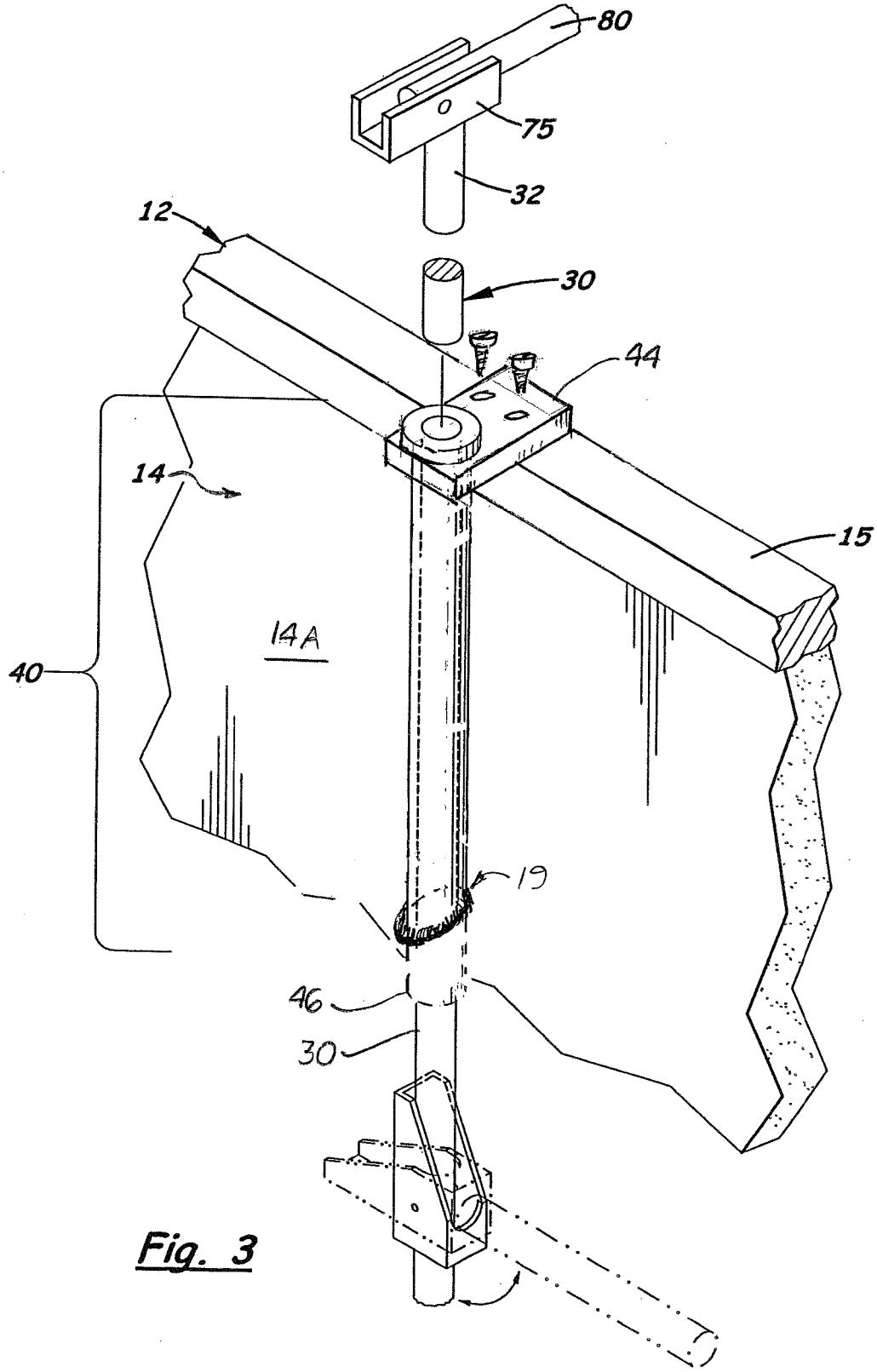
FIG. 3 is a perspective side view of the sidewall of a rowboat showing the mounting tube attached to the inside surface.

As shown in FIG. 3, attached to the upper end 32 of the rotating post 30 is a handle hinge 75. In the preferred embodiment, the handle hinge 75 is an elongated, U-shaped structure perpendicularly mounted on the upper end 32 of the rotating post 30.

Figure 9:
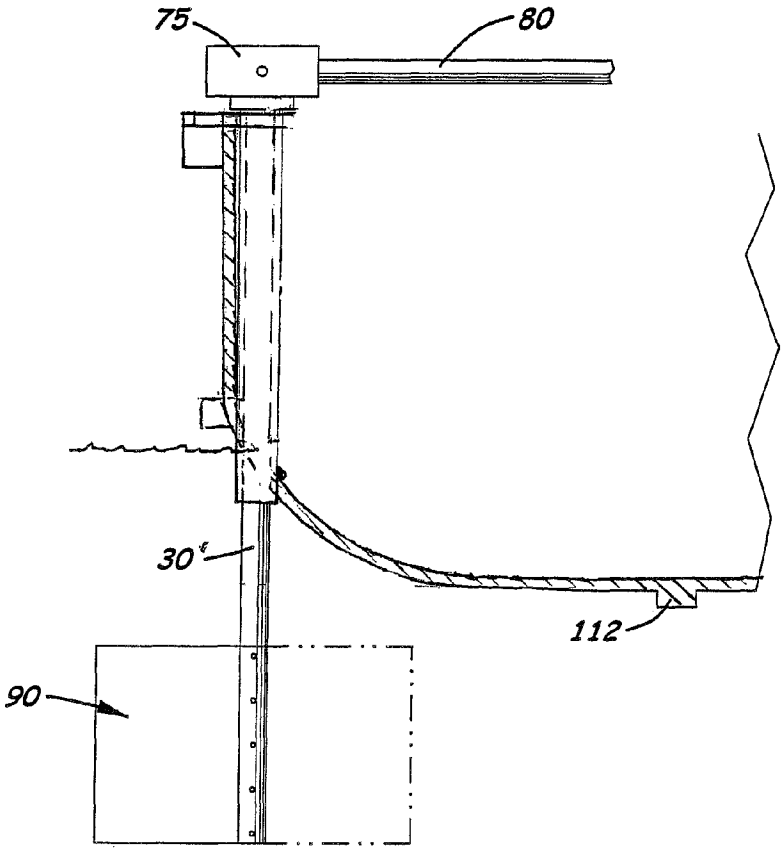
FIG. 9 is a front elevational view of the rowing system showing the relative location of the fin with respect to the keel.
Figure 8:
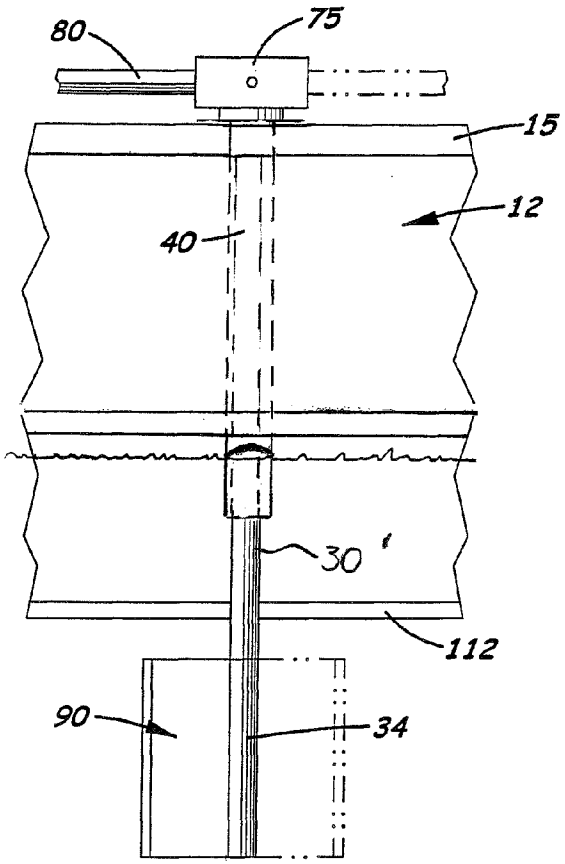
FIG. 8 is a side elevational view of a second embodiment of the rowing system showing the fin securely attached to the lower end of the post that extends below the keel.
Figure 10:
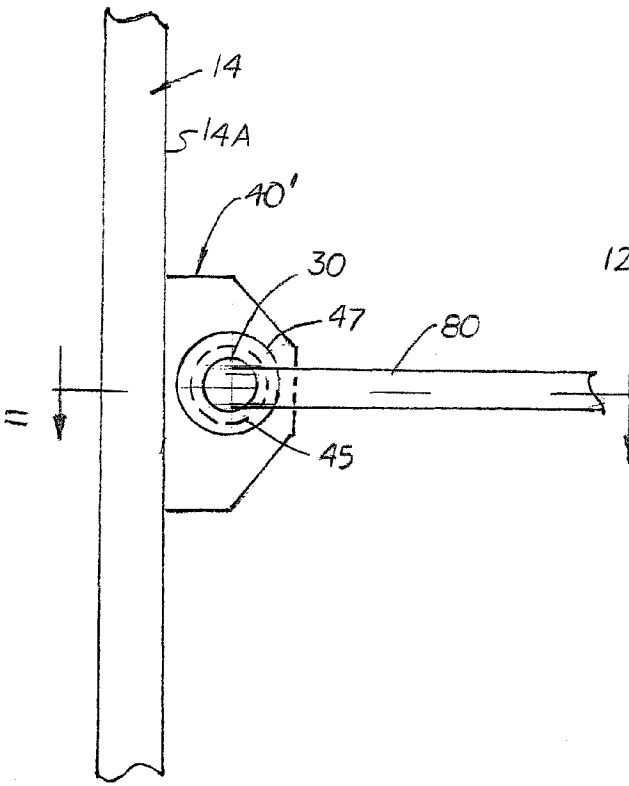
FIG. 10 is a top plan view of the side of the watercraft showing the relative position of the fixed mounting post, the position of the intermediate post, the rotating post, and the handle.

In addition to showing the mounting tube 40, FIGS. 8 and 9 also show the rotating post 30, and stop hinge 70 and fin arm 66 being replaced by a longer rotating post 30'. The fin 90 is perpendicularly aligned and attached along its front edge to the lower section 34' of the post 30'. The post 30' is sufficient in length so that the fin 90 extends below the keel 112 thereby allowing the fin 90 to rotate free 360 degrees.

Figure 2:
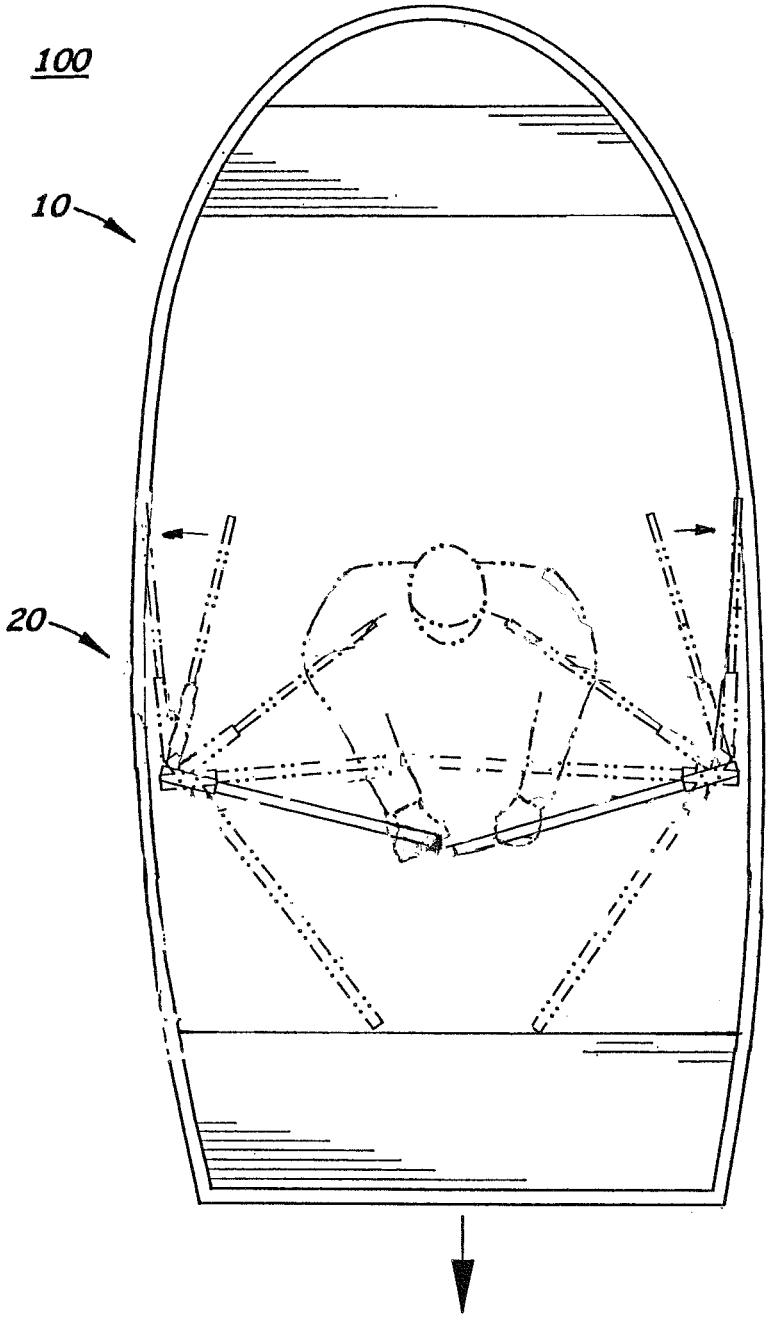
FIG. 2 is a top plan view of a rowboat shown in FIG. 1 showing the rower rowing the rowboat in a rearward direction.
Figure 6:
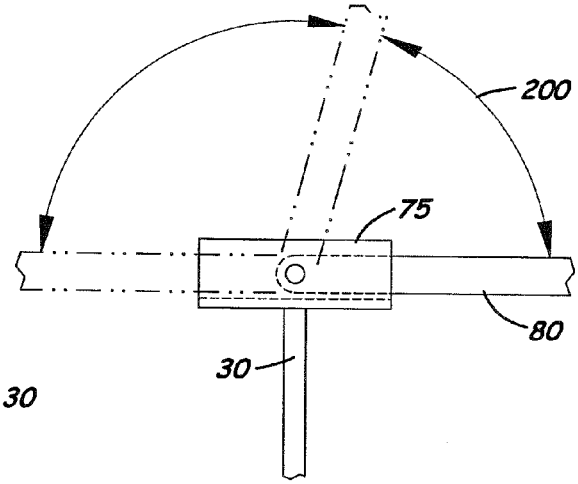
FIG. 6 is a side elevational view of the handle bracket with the handle being rotated 180 degrees over the handle bracket.

A rowing handle 80 is longitudinally aligned and attached at one end of the handle hinge 75. During use, the handle 80 extends inward and grasped by the rower 105. As shown in FIG. 6, the handle 80 is pivotally attached to the handle hinge 75 and is able to swing in a vertical 180 degree arc there over thereby allowing the rower 95 to sit in a normal rearward facing or forward facing direction and row in a forward direction as shown in FIG. 1, or in a reward facing direction as shown in FIG. 2.

In the preferred embodiment, the handle 80 is a hollow tube made of stainless steel and is approximately 24-36" in length and 1 inch in diameter. On the distal end of the handle 80 is an optional gripping sleeve made of rubber. The post 30 measures ¾ inch in diameter and 12-24 inches in length. The tube 60 measures 12-24 inches in length. The fin arm 66 that attaches to the post 30, measures 6-12 inches in length. The two fins 90, 90' are approximately 36-48 inches in length to 10 to 16 inches in width and have a tapered shape approximately 1½ inches thick in front and ¼ of an inch along the rear.

During use, the rower 95 grasps the free ends of the two rowing handles 80, 80' attached to the opposite rowing assemblies 20, 20', respectively, and then sweeps them back and forth in a 45 degree horizontal arc over the inside area of the hull. As the handles 80, 80' are swept back and forth along the arc, the two fins 90, 90' move back and forth in a 45 degree horizontal arc located in the water 100 and under the rowboat 12 to propel the rowboat 12 through the water 100. The rower 95 is able to lift and rotate each rowing handle 80, 80' in 180 degrees along a vertical arc (designated 200 in FIG. 6) over the handle hinge 75 and rotate the post 30 or 30', up to 360 degrees to change the orientation of the fins 90, 90' in the water 100 for propelling the rowboat 12 in the opposite direction without changing his or her position in the rowboat 12.

In compliance with the statute, the invention described herein has been described in language more or less specific as to structural features. It should be understood however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. An internally mounted small watercraft rowing fin system, comprising:

a. a hull with two opposite sidewalls each with a gunwale, an inside surface, and a chine;

b. a hollow, vertically aligned mounting tube integrally attached or formed on said inside surface on each said sidewall, said mounting tube extending downward along said inside surface and through said hull and terminating at or near said chine;

c. two rotating fin assemblies mounted on the opposite sidewalls of a watercraft, each said fin assembly including a rotating post longitudinally aligned inside said mounting tube, each said rotating post being sufficient in length and has an upper end that is located adjacent to said gunwale and a lower end that extends below said mounting tube, each said rotating fin assembly also includes a handle hinge securely mounted on said upper end of said rotating post and a perpendicularly aligned fin attached to a section said rotating post that extends below said mounting tube; and, d. a rowing handle attached at one end to each said handle hinge, said rowing handle and said handle hinge being configured so that said handle may extend inward and grasped by a rower when rowing or said handle may swing in a vertical 180 degree arc over said handle hinge thereby allowing a rower sitting in a rearward facing or forward facing direction grasp said handle and row.

2. The rowing fin system, as recited in claim 1, further including a stop hinge pivotally attached to said lower end of said post and a fin arm attached to said stop hinge disposed between said post and said fin.

3. The rowing fin system, as recited in claim 1, wherein said fin is made of flexible material.

4. The rowing fin system, as recited in claim 2, wherein said fin is made of flexible material.

5. The rowing fin system, as recited in claim 2, wherein said handle hinge is an elongated U-shaped bracket.

6. The rowing fin system, as recited in claim 1, wherein said post is sufficient in length so that said fin may be rotated under said watercraft.

7. The rowing fin system, as recited in claim 1, wherein said handle hinge is an elongated U-shaped bracket.

8. The rowing system, as recited in claim 2, wherein said fin arm when longitudinally aligned with said post is sufficient in length so that said fin attached to said fin arm may be rotated under said watercraft.

9. The rowing system, as recited in claim 1 further including a hollow, elongated sleeve longitudinally aligned and disposed inside each said mounting tube.

* * * * *